US009809020B1

(12) United States Patent
McCue

(10) Patent No.: US 9,809,020 B1
(45) Date of Patent: Nov. 7, 2017

(54) SIMULTANEOUS SCREEN REGISTRATION SYSTEM

(71) Applicant: Geoff McCue, Lawrences, KS (US)

(72) Inventor: Geoff McCue, Lawrences, KS (US)

(73) Assignee: Lawson Screen Products, Inc., St. Louis, MO (US)

( * ) Notice: Subject to any disclaimer, the term of this patent is extended or adjusted under 35 U.S.C. 154(b) by 0 days.

(21) Appl. No.: 15/423,841

(22) Filed: Feb. 3, 2017

(51) Int. Cl.
*B41F 15/34* (2006.01)
*B41F 27/00* (2006.01)

(52) U.S. Cl.
CPC ..... *B41F 27/005* (2013.01); *B41F 15/34* (2013.01)

(58) Field of Classification Search
CPC ..... B41F 15/0863; B41F 15/08; B41F 15/34
USPC ..... 101/127.1, 115
See application file for complete search history.

(56) References Cited

U.S. PATENT DOCUMENTS

2008/0072775 A1* 3/2008 Landesman ..... B41F 15/04 101/115
2014/0053743 A1* 2/2014 Okawa ..... B41F 15/08 101/128.1

* cited by examiner

*Primary Examiner* — Leslie J Evanisko

(57) ABSTRACT

An automatic screen registration device for a registering a screen printing frame and method of use that includes generally (1) a print head or plurality of print heads; (2) frame or frames attached directly to the print head(s) and (3) a means for positioning a screen in the frame(s). The present invention uses a multi-point registration system that is attached to each print head of a screen printing system.

16 Claims, 10 Drawing Sheets

SIMULTANEOUS SCREEN REGISTRATION SYSTEM

RELATED APPLICATIONS

None.

FIELD

The present invention relates to the field of screen printing. More specifically, the present invention relates to a device and method for simultaneously aligning screens in registration.

BACKGROUND

Printed indicia which are applied to T-shirts and other articles of clothing are very popular. Several Internet Stores that specialize in printing fanciful indicia such as ornamentation, slogans, college names, or sports team names on T-shirts and other clothing have surged in popularity.

Screen printing is a printing technique whereby a mesh is used to transfer ink onto a substrate, except in areas made impermeable to the ink by a blocking stencil. Registration, as it relates to screen printing, is simply the process of making sure that the design lines up exactly as it should for the print.

It is important to position the screens and secure them properly to make sure every article of clothing gets the same print in the same location. As such, the most critical and time-consuming part of the screen printing process involving multiple colors is the alignment or registration of successive screens. Each screen for each color must be in registration with the other screens to ensure that the various colors do not overlap or are incorrectly spaced. Otherwise, the printed indicia will not be in registration, resulting in a skewed or imperfect indicia. Screens can be manually registered or machine registered.

Traditional machine registered multicolor screen printing uses machines with multiple print heads (1 for each color). They also have multiple printing arms (receivers). A traditional screen registration device uses a 2-3 point registration device that attaches to the receiver arm. This device must be moved (rotated) under each print head. Screens are manually placed against the registration points and then locked by the frame holder attached to the print head. This process must be repeated for each color of a print job at each print head. It must also be repeated for each individual print job. It would therefore be useful to provide a registration device that attaches to the print heads rather than the printing arm/receiver to allow all screens of a print job to be simultaneously registered.

BRIEF SUMMARY OF THE INVENTION

It is the object of the present invention to address several challenges in previous attempts to register screens in a screen printing device. The present invention is an automatic screen registration device for a registering a screen printing frame and method of use that includes generally (1) a print head or plurality of print heads; (2) frame or frames attached directly to the print head(s) and (3) a means for positioning a screen in the frame(s).

The present invention uses a multi-point registration system that is attached to each print head of a screen printing system. The system uses multiple blocks to contact the screen and moveable devices (such as air cylinders) assist the screen in making and maintaining contact. The blocks are mounted to adjustable plates, which are then mounted to adjustable brackets that mount the entire assembly to the print head. Alignment is performed with an alignment frame mounted to the receiver arm and rotated to each print head for alignment and locking. Since the registration is now mounted to each print head, alignment only needs to done at the machine assembly, installation or as part of normally scheduled maintenance. So, during actual use for registering screens, they are loosely placed in the frame holder and activated to position all screen simultaneously.

DETAILED DESCRIPTION

Figure 1:
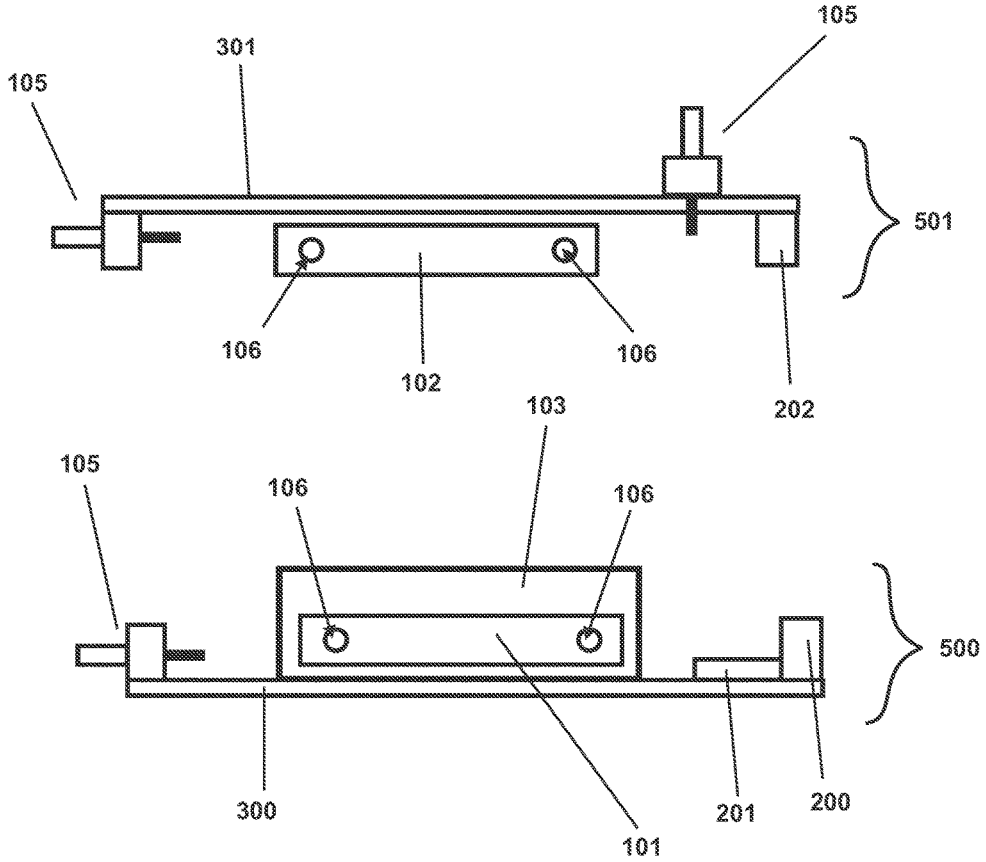
FIG. 1 is top view of the automatic screen registration device of the present invention.

Turning to FIG. 1, the registration device of the present invention is shown. A front registration assembly 500 sits opposite and parallel to the rear registration assembly 501. The front frame 300 of the front registration assembly 500 is parallel to an opposing frame 301 of the rear registration assembly 501. The frames 300 and 301 each having a pair of opposing side edges and a pair of opposing end edges. A first block 202 extends perpendicularly from the side edge at the end of the rear frame 301 to create a first corner between the first block 202 and front frame 301. A second block 200 extends perpendicularly from the side edge at the end of the front frame 300 such that the first block 202 and second block 200 are opposing. A third block 201 is parallel to the side edge of the front frame 300 and perpendicular to the second block 200 to form a second corner.

The device uses a means for positioning a screen between opposing frames 300 and 301 and adjacent to the first and second corners. The positioning means can include, but is not limited to, air cylinders, levers, mechanical means or other positioning device well known within the prior art. In the preferred embodiment, as shown throughout the Figures, the device uses air cylinders 105 located along the end edge of the first and second frame 300 and 301 that is opposite the first and second blocks 202 and 200. The air cylinders 105 are adapted to push the screen towards and adjacent to the first and second blocks 202 and 200. A third air cylinder 105 located along the side edge of the front frame 301 with the third air cylinder 105 being adapted to push the screen towards the second and third block 200 and 201 and adjacent to the second corner.

Figure 6:
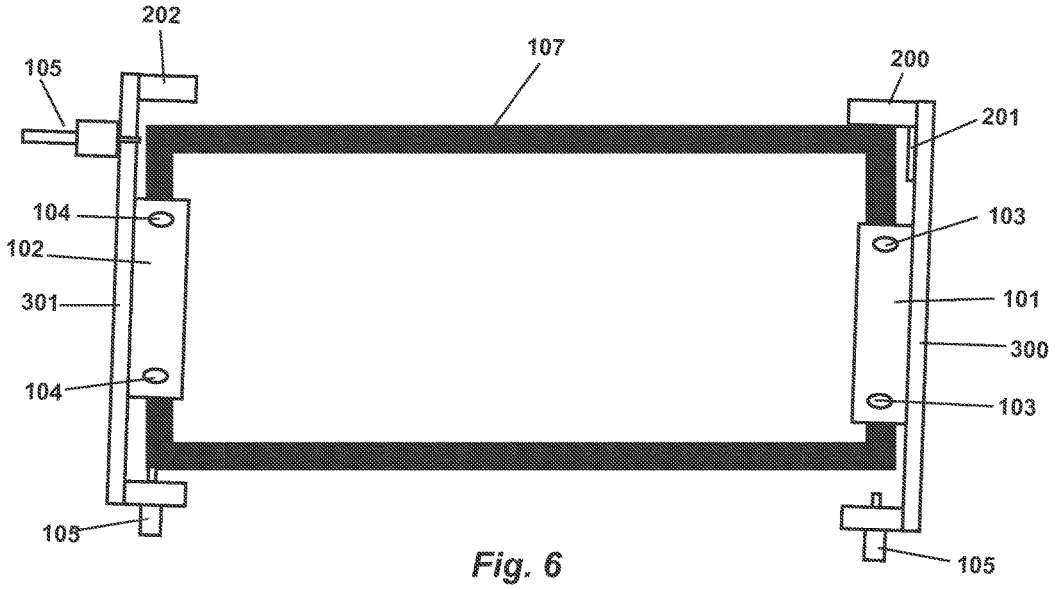
FIG. 6 is top view of the present invention not engaged in registration to the alignment frame.
Figure 7:
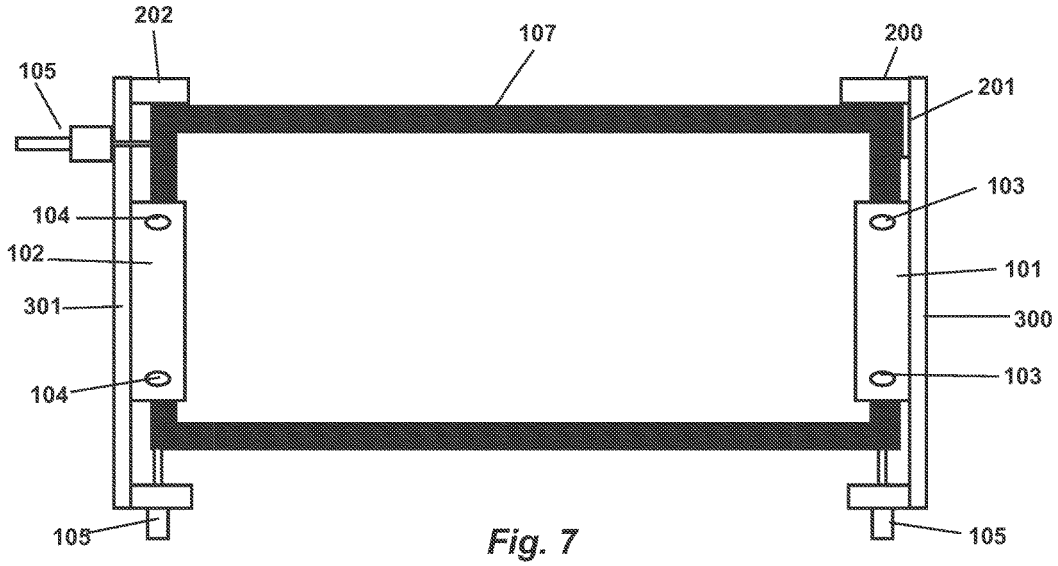
FIG. 7 is a top view of the present invention engaged in registration around the alignment frame.

A printing screen is held within the front screen frame holder 101 and rear screen frame holder 102 as shown in further detail in FIGS. 6-7.

Figure 2:
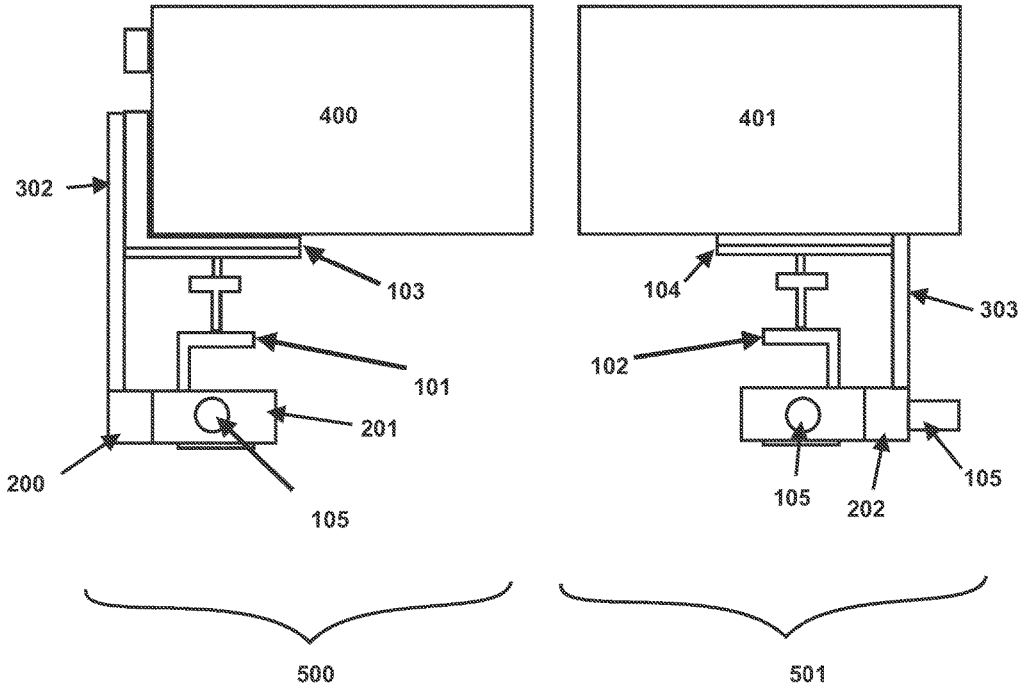
FIG. 2 is a side view of the automatic screen registration device of the present invention mounted on the print head.

The device may further employ a microregistration system, with the front microregistration system 103 shown in FIG. 1. and the front microregistration system 103 and rear microgregistration system 104 shown in FIG. 2. Microregistration systems are used to correct minor registration errors due to art, handling or machine deficiencies. Screen frames are clamped into position and when the printing starts, minor adjustments can be made without unclamping and moving the screen which is cumbersome and often just as inaccurate. Microregister uses screw type of adjustment (dial adjusters and micro locks) without unlocking the frame.

Figure 3:
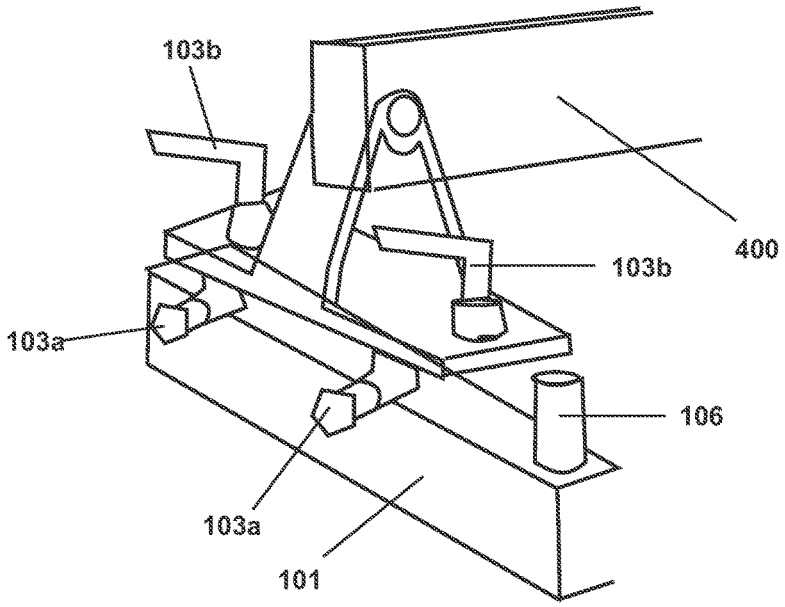
Prior art Fig. 3
FIG. 3 is a perspective side view of a prior art print head with screen clamps and microregistration components.
Figure 4:
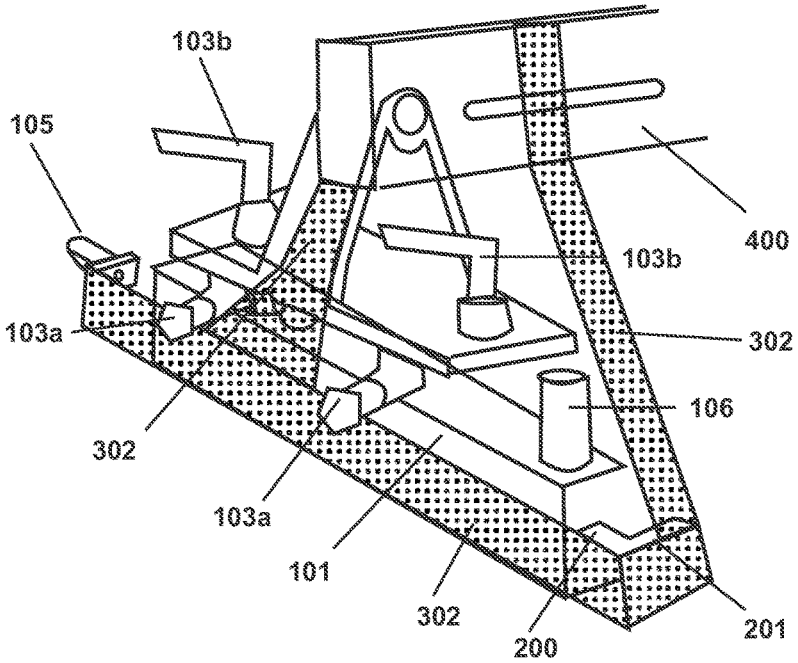
FIG. 4 is a perspective side view of the prior art device in FIG. 3 with the present invention attached to the print head.

As shown in FIG. 1 and further in FIGS. 3 and 4, a screen 100 is held in place by screen frame clamps 106.

Turning to FIG. 2, the frame holders 101 and 102 are adjustably positioned on the front print head 400 and rear print head 401 using front bracket 302 and rear bracket 303, respectively.

Turning to FIG. 3, a side view of traditional print head 400 is shown attached to the front screen frame holder 101 with screen clamp 106. The microregistration system 103 uses dial adjusters 103*a* and micro locks 103*b*.

Turning to FIG. 4, a side view of the front registration system 500 of FIG. 2 is shown. The microregistration system uses dial adjusters 103*a* and micro locks 103*b*. The front frame 300 of the screen registration system of the present invention is mounted using a bracket 302. Air cylinder 105 pushes frame towards the corner created by blocks 200 and 201.

Figure 5:
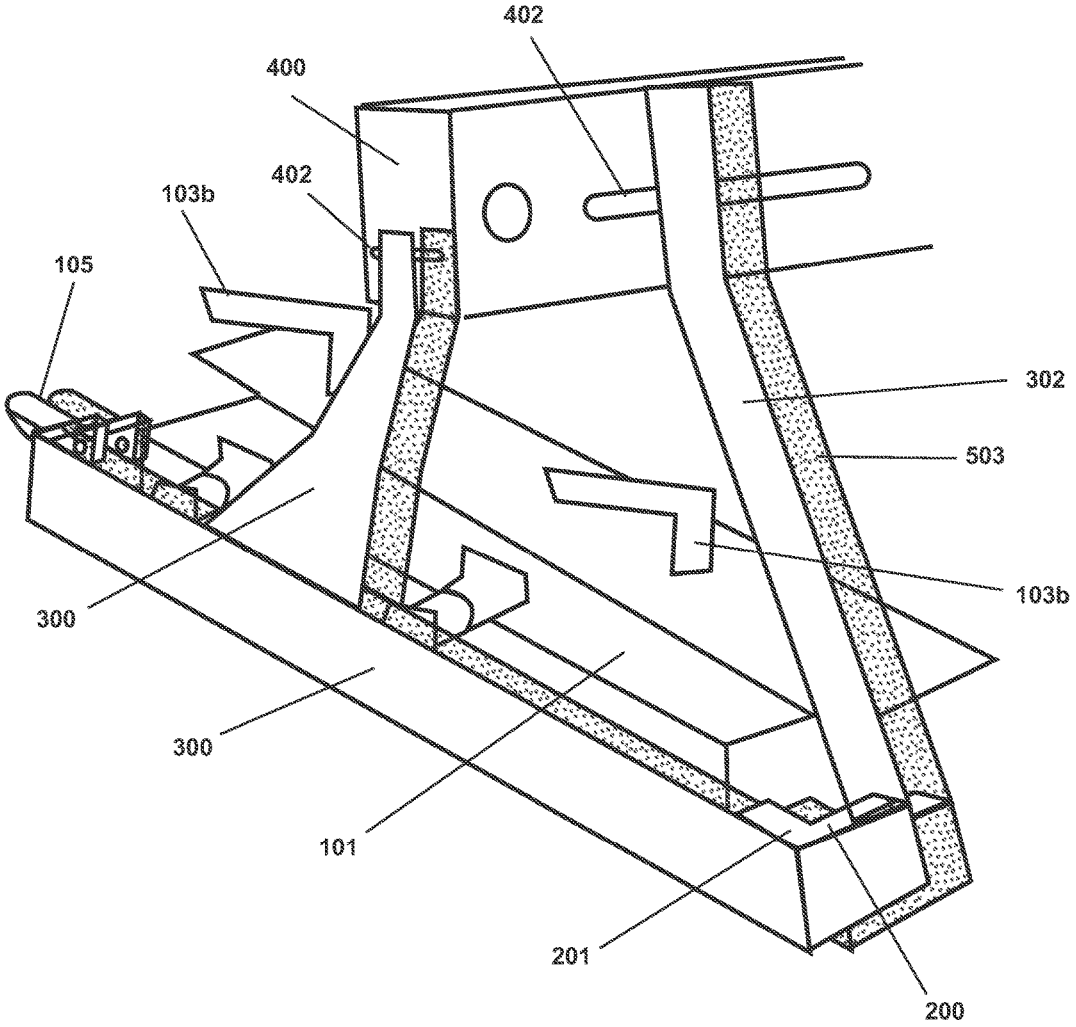
FIG. 5 is a perspective side view showing screen registration bracket in an unlocked and locked position.

Turning to FIG. 5, the bracket 302 is adjustable along the print head 400. In the preferred embodiment, the bracket is moved along the print head using the bracket adjustment slots 402. The microregistration system uses dial adjusters 103*a* and micro locks 103*b*. The front frame 300 of the screen registration system of the present invention is mounted using a bracket 302. Air cylinder 105 pushes frame towards the corner created by blocks 200 and 201. The bracket 302 is moved from an unlocked position to a locked position 503 and thereby locks the screen registration assembly 500 in place.

Turning to FIGS. 6 and 7, a top view of the present invention not engaged in registration (FIG. 6) and engaged in registration (FIG. 7) is shown. An alignment frame 107 is positioned between frames 300 and 301 each having a pair of opposing side edges and a pair of opposing end edges. A first block 202 extends perpendicularly from the side edge at the end of the rear frame 301 to create a first corner between the first block 200 and front frame 301. A second block 200 extends perpendicularly from the side edge at the end of the front frame 300 such that the first block 202 and second block 200 are opposing. A third block 201 is parallel to the side edge of the front frame 300 and perpendicular to the second block 200 to form a second corner.

The device uses a means for positioning a screen between opposing frames 300 and 301 and adjacent to the first and second corners. The positioning means can include, but is not limited to, air cylinders, levers, mechanical means or other positioning device well known within the prior art. In the preferred embodiment, as shown throughout the Figures, the device uses air cylinders 105 located along the end edge of the first and second frame 300 and 301 that is opposite the first and second blocks 202 and 200. The air cylinders 105 are adapted to push the screen towards and adjacent to the first and second blocks 202 and 200. A third air cylinder 105 located along the side edge of the front frame 301 with the third air cylinder 105 being adapted to push the screen towards the second and third block 200 and 201 and adjacent to the second corner.

The device may further employ a microregistration system, with the front microregistration system 103 and rear microgregistration system 104.

Figure 8:
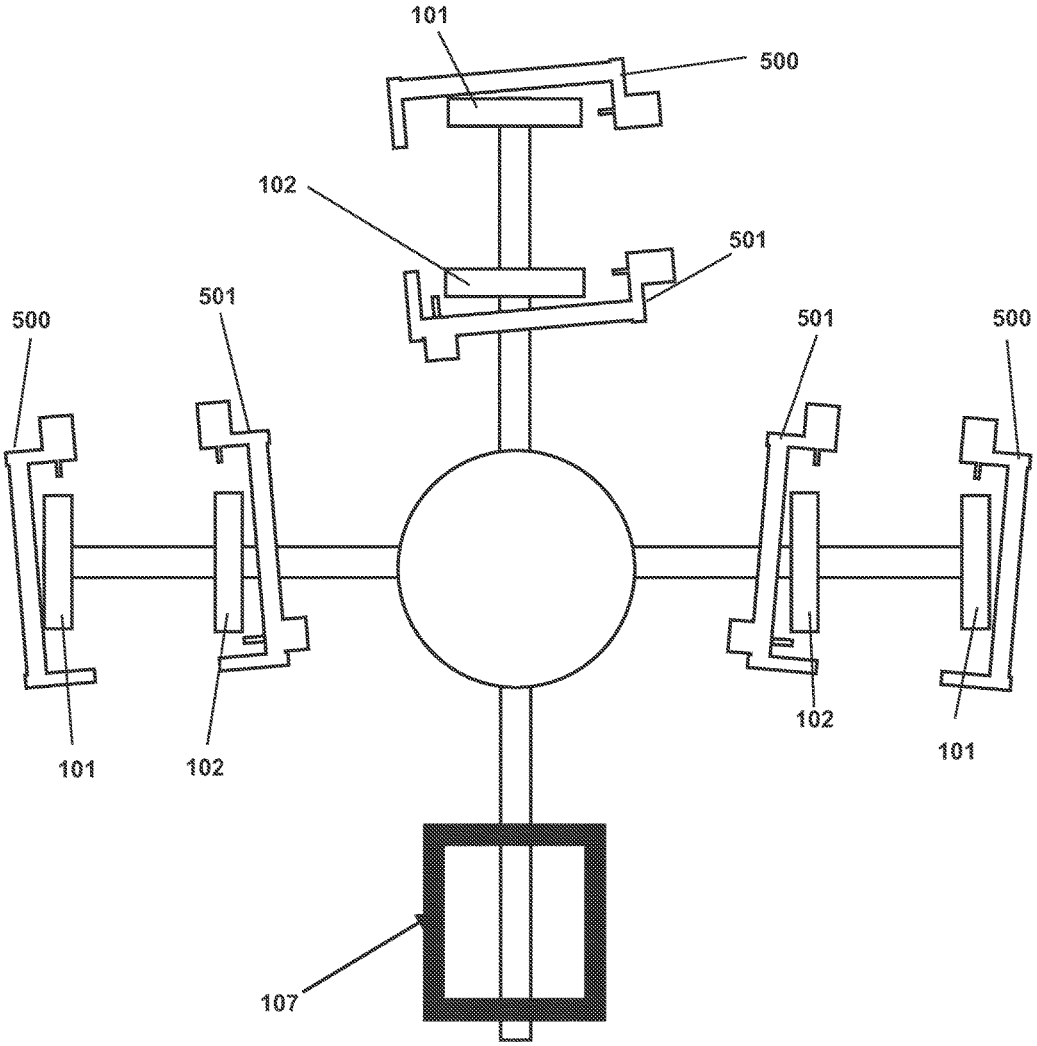
FIG. 8 is a top view of the simultaneous registration system of the present invention mounted on a printing press and not engaged in simultaneous registration around the alignment frame for the first print head.
Figure 9:
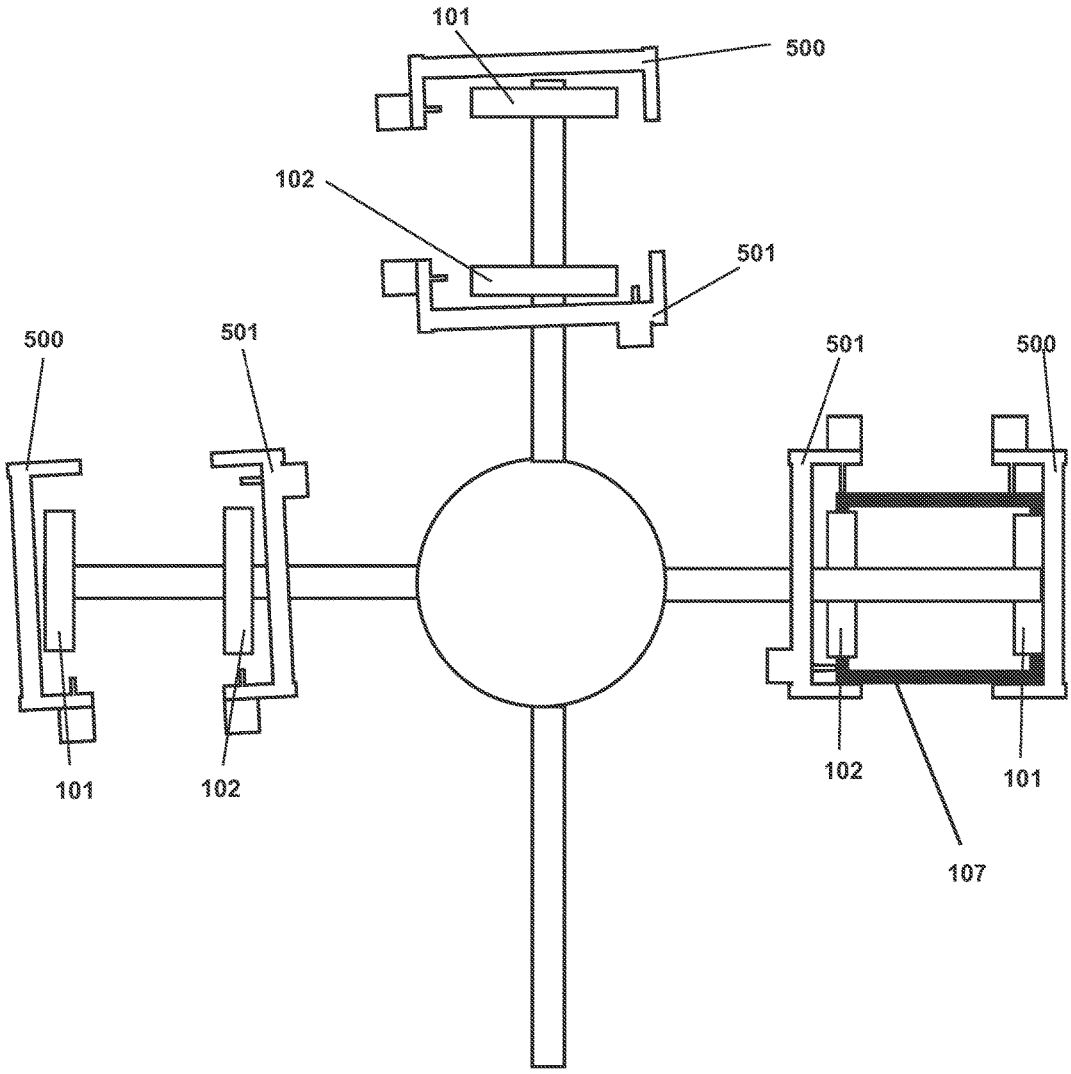
FIG. 9 is a top view of the present invention mounted on a printed press, locked and engaged in registration around the alignment frame or the first print head.

Turning to FIGS. 8 and 9, a top view of the simultaneous registration system of the present invention mounted on a printing press and not engaged (FIG. 8) and engaged (FIG. 9) in simultaneous registration is shown. A plurality of screen registration devices is used. In FIG. 8, a screen alignment frame 107 is shown in a screen printing system prior to moving into position on one of the automatic screen registration devices and FIG. 9 shows the screen alignment frame 107 is shown in position on one of the automatic screen registration devices. Front brackets 500 of each registration device is adjacent to the front screen holders 101 and rear brackets 501 of each registration device is adjacent to the rear screen holders 102.

Figures 10A, 10B:
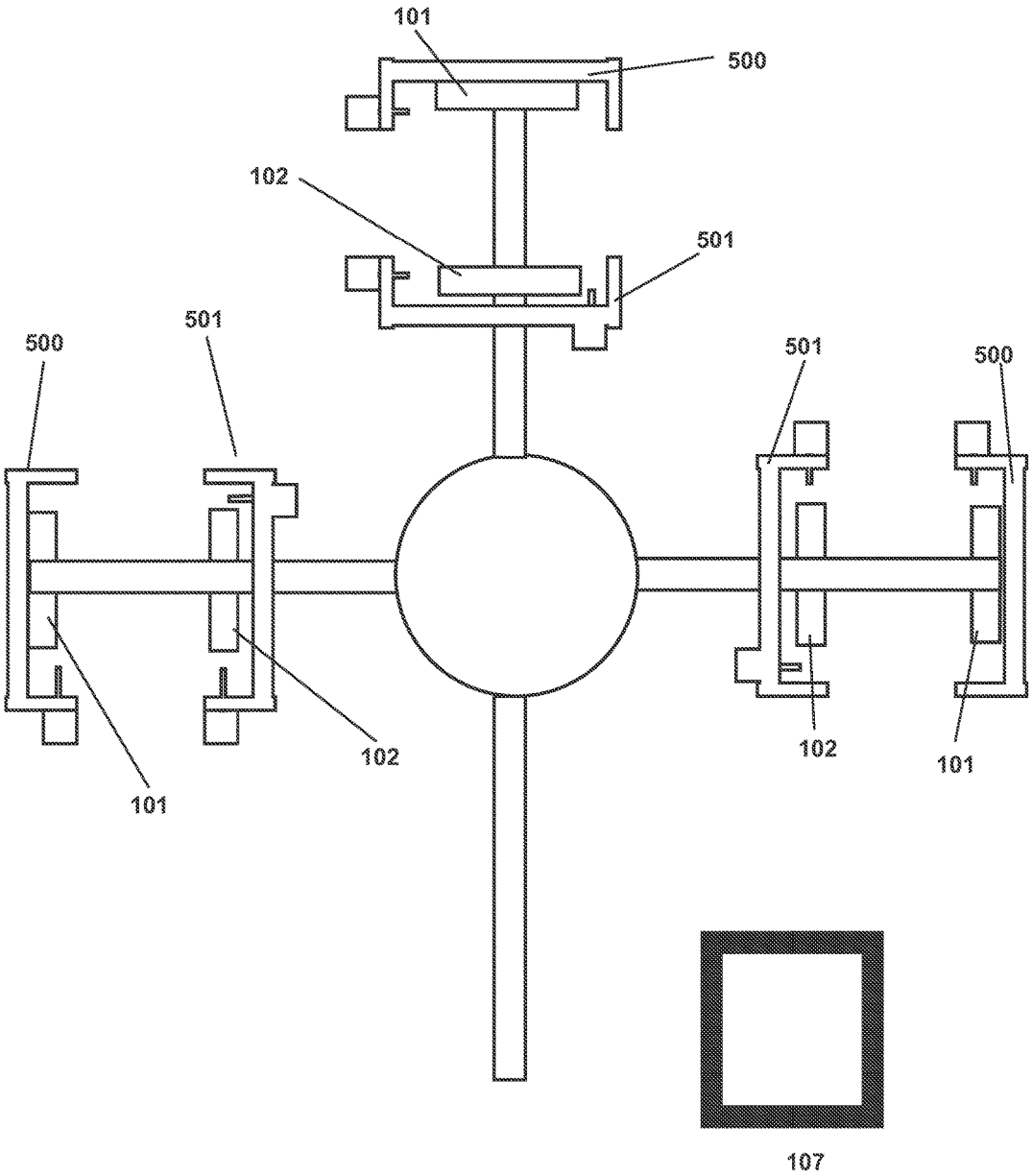
FIG. 10A is a top view of the present invention mounted on a printing press and all engaged in registration for all print heads.
FIG. 10B is a top view of the alignment frame of the present invention.

Turning to FIG. 10, a top view of the simultaneous registration system of the present invention mounted on a printing press and engaged in simultaneous registration. Front brackets 500 of each registration device is adjacent to the front screen holders 101 and rear brackets 501 of each registration device is adjacent to the rear screen holders 102. The alignment frame 107 is removed for simultaneous screen registration.

Figure 11:
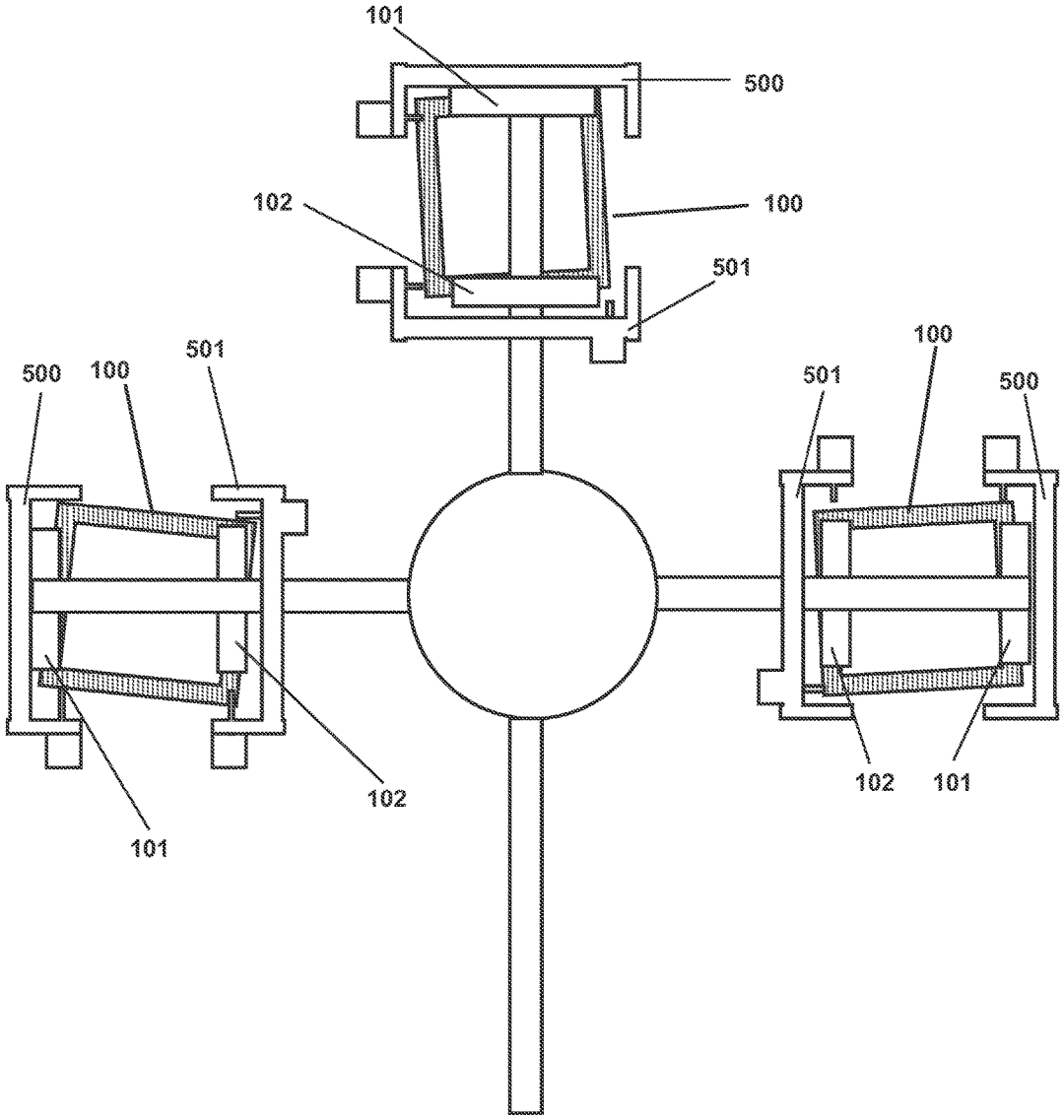
FIG. 11 is a top view of the simultaneous registration system of the present invention prior to engaging multiple, simultaneous screens into registration.

Turning to FIG. 11, a top view of the simultaneous registration system of the present invention is shown prior to engaging simultaneous registration devices. Front brackets 500 of each registration device is adjacent to the front screen holders 101 and rear brackets 501 of each registration device is adjacent to the rear screen holders 102. Screen frames 100 are shown out of alignment (not registered) in the devices.

Figure 12:
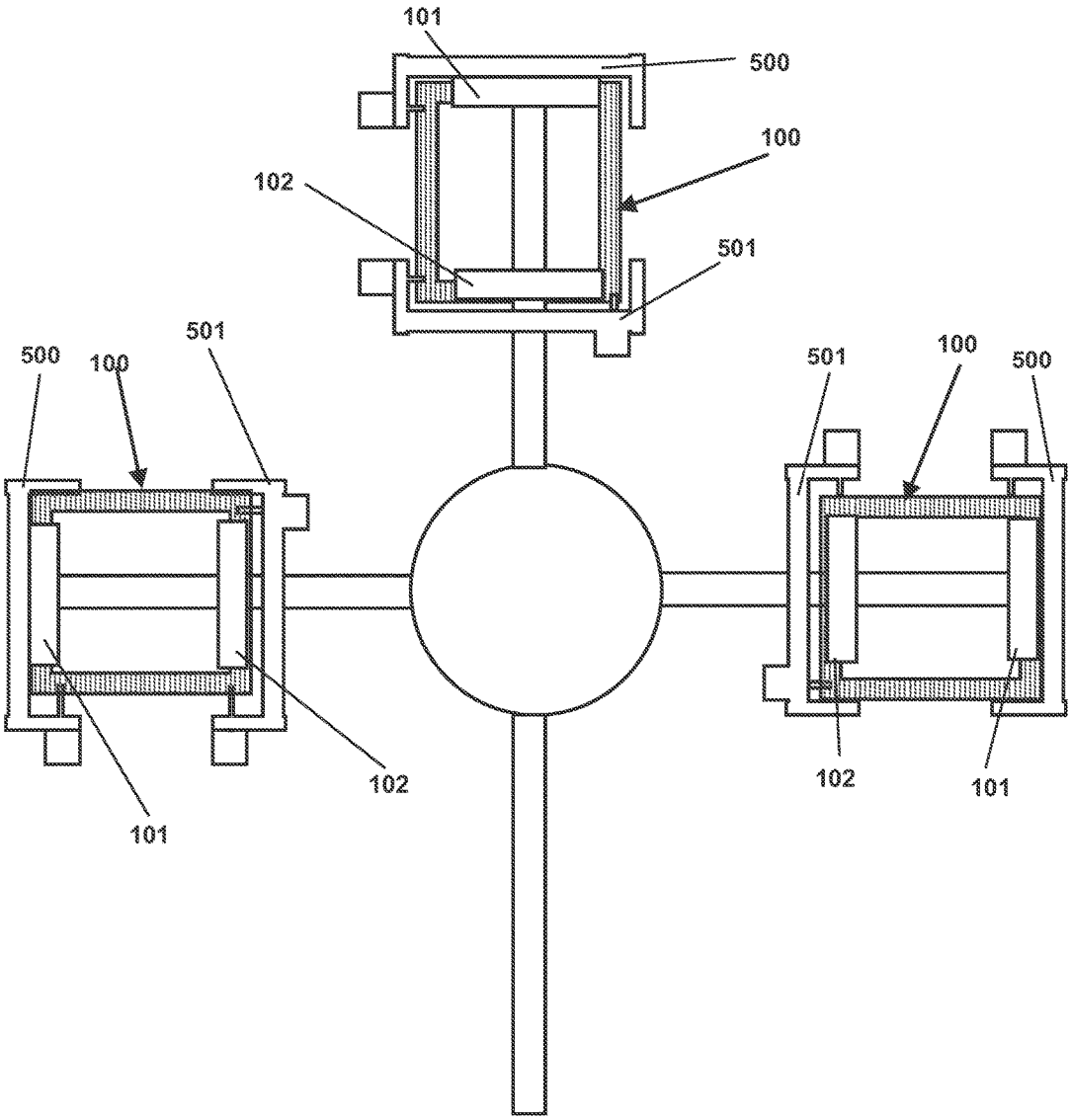
FIG. 12 is a top view of the simultaneous registration system of the present invention after engaging multiple, simultaneous screens into registration.

Turning to FIG. 12, a top view of the simultaneous registration system of the present invention is shown after engaging the simultaneous registration devices. Front brackets 500 of each registration device is adjacent to the front screen holders 101 and rear brackets 501 of each registration device is adjacent to the rear screen holders 102. Screen frames 100 are shown properly aligned and registered in the devices.

When the system is engaged, all screens 100 are registered simultaneously between the front screen frame holders 101 and rear frame holders 102 by the positioning means (air cylinders) of the front brackets 500 and rear bracket 501. The entire system is powered by air. The air cylinders engage the screen and move it into registration. Once in position, the screen locks 106 are engaged, either manually or with air, and the registered screen is locked in position. If there are multiple screens they are simply placed on each print head in the apparatus. When the air is switched on, they all move into registration at the same time (simultaneously) and another flip of a switch allows all frames to be locked in place.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the method (and components of the individual operating components of the method) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections might be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. An automatic screen registration device for registering a screen printing frame comprising:

a. a print head;

b. a first and second frame opposing one another attached to the print head, each frame having a pair of opposing side edges and a pair of opposing end edges;

c. a first block extending perpendicularly from the side edge at one end of the first frame to create a first corner between the first block and first frame;

d. a second block extending perpendicularly from the side edge at one end of the second frame such that the first block and second block are opposing;

e. a third block parallel to the side edge of the second frame and perpendicular to the second block to form a second corner between the second and third blocks; and f. means for positioning a screen between said pair of opposing frames and adjacent to the first and second corners.

2. The automatic screen registration device of claim 1 wherein said positioning means comprises:

a. a first and second air cylinders located along the end edge of the first and second frame that is opposite the first and second blocks, said first and second air cylinders adapted to push the screen towards and adjacent to the first and second blocks;

b. a third air cylinder located along the side edge of the first frame, said third air cylinder adapted to push the screen towards the second and third block adjacent to the second corner.

3. The automatic screen registration device of claim 1 wherein the frames are adjustably attached and positioned on the print head.

4. The automatic screen registration device of claim 1 further comprising a plurality of predetermined locking positions on the print head wherein the frames are adjustably positioned and locked along the side edges and end edges of the first and second frame.

5. In a screen printing system, a registration apparatus for simultaneously registering a plurality of screens comprising:

a. a plurality of automatic screen registration devices for registering a plurality of screen printing frames, each screen registration device comprising:

i. a print head;

ii. a first and second frame opposing one another and attached to each print head, the first and second frame each having a pair of opposing side edges and a pair of opposing end edges;

iii. a first block extending perpendicularly from the side edge at one end of the first frame to create a first corner between the first block and first frame;

iv. a second block extending perpendicularly from the side edge at one end of the second frame such that the first block and second block are opposing;

v. a third block parallel to the side edge of the second frame and perpendicular to the second block to form a second corner between the second and third blocks;

vi. means for positioning each screen between said pair of opposing frames and adjacent to the first and second corners.

6. The registration apparatus for simultaneously registering a plurality of screens of claim 5 wherein said positioning means comprises:

a. a first and second air cylinders located along the end edge of the first and second frame that is opposite the first and second blocks, said first and second air cylinders adapted to push the screen towards and adjacent to the first and second blocks;

b. a third air cylinder located along the side edge of the first frame, said third air cylinder adapted to push each screen towards the first and second block adjacent to the second corner.

7. The registration apparatus for simultaneously registering a plurality of screens of claim 5 further comprising:

a. a rear frame holder;

b. a front screen frame holder; and c. a micro-registration system wherein the first and second frames of each screen registration device are attached to each print head independent of each microregistration system.

8. The registration apparatus for simultaneously registering a plurality of screens of claim 5 wherein the frames are adjustably attached and positioned on the print head.

9. The registration apparatus for simultaneously registering a plurality of screens of claim 5 further comprising a plurality of predetermined locking positions on the print head wherein the frames are adjustably positioned and locked along the side edges and end edges of the first and second frame.

10. A method for simultaneous registration of a plurality of images on a plurality of screens secured in a plurality of screen frames in a screen printer having a succession of screenprinting stations for printing successive images on a workpiece carried through the successive printing stations, said method comprising the steps of:

a. providing a support for securing each of the screens to one of a plurality of image positives;

b. bringing each of the screen frames to the support and simultaneously registering each screen using a plurality of registration apparatuses for registering a plurality of screens, each registration apparatus comprising:

i. a print head;

ii. a first and second frame opposing one another and attached to the print head, each frame having a pair of opposing side edges and a pair of opposing end edges;

iii. a first block extending perpendicularly from the side edge at one end of the first frame to create a first corner between the first block and first frame;

iv. a second block extending perpendicularly from the side edge at one end of the second frame such that the first block and second block are opposing;

v. a third block parallel to the side edge of the second frame and perpendicular to the second block to form a second corner between the second and third blocks;

vi. means for positioning each screen between said pair of opposing frames and adjacent to the first and second corners;

c. simultaneously aligning each screen between each pair of opposing frames and adjacent to the first and second corners.

11. The method of claim 10 wherein each registration apparatus further comprises:

a. a rear frame holder;

b. a front screen frame holder; and c. a microregistration system wherein each of the frames are attached to each print head independent of each microregistration system.

12. The method of claim 10 wherein the means for aligning each screen between each pair of opposing frames comprises:

a. a first and second air cylinders located along the end edge of the first and second frame that is opposite the first and second blocks, said first and second air cylinders adapted to push each screen towards and adjacent to the first and second blocks;

b. a third air cylinder located along the side edge of the first frame, said third air cylinder adapted to push each screen towards the first and second block adjacent to the second corner.

13. The method of claim 12 in which the step of aligning each screen frames includes the step of engaging the first, second and third air cylinders.

14. The method of claim 13 further comprising engaging the microregistration system after aligning the screens.

15. The method of claim 10 wherein the frames are adjustably positioned on the print head.

16. The method of claim 10 further comprising a plurality of predetermined locking positions on the print head wherein the frames are adjustably positioned and locked along the side edges and end edges of the first and second frame.

* * * * *